United States Patent [19]

Skagerlund et al.

[11] 3,962,972

[45] June 15, 1976

[54] DEVICE FOR EMITTING RADIATION, FOR A PROJECTILE, SHELL ETC.

[75] Inventors: Lars-Erik Skagerlund; Rolf Lennart Stalfors, both of Karlskoga, Sweden

[73] Assignee: AB Bofors, Bofors, Sweden

[22] Filed: July 10, 1974

[21] Appl. No.: 487,102

[30] Foreign Application Priority Data

Aug. 3, 1973 Sweden ..... 7310678

[52] U.S. Cl. ..... 102/70.2 R

[51] Int. Cl.[2] ..... F42C 13/02

[58] Field of Search ..... 102/70.2 P, 70.2 G, 102/70.2 R; 136/205

[56] References Cited

UNITED STATES PATENTS

| | | | |
|---|---|---|---|
| 2,137,598 | 11/1938 | Vos | 102/70.2 P |
| 2,255,245 | 9/1941 | Ferrel | 102/70.2 P |
| 2,998,771 | 9/1961 | Mosier | 102/70.2 P |
| 3,483,821 | 12/1969 | Brothers | 102/70.2 R |

*Primary Examiner*—Charls T. Jordan

*Attorney, Agent, or Firm*—Elliott I. Pollock

[57] ABSTRACT

A radiation emitter for a projectile comprises a pyrotechnical charge located within the body of the projectile, and connected via a channel within the body to an opening in the side of said projectile to emit radiation via said opening when the pyrotechnical charge has been ignited. The radiation emitter may comprise the transmitter unit of a proximity fuze carried by the projectile.

9 Claims, 2 Drawing Figures

DEVICE FOR EMITTING RADIATION, FOR A PROJECTILE, SHELL ETC.

The present invention relates to a device for emitting radiation, for a projectile, shell etc. which is intended to transmit a beam through an opening made in the body of the projectile. The equipment for emitting the beam of radiation can be included in, for instance, a distance-sensing proximity fuze which, in addition to said radiation emitting equipment, is provided with receiver equipment which is arranged to receive radiation reflected from an object and in dependence of this initiate a payload which is carried in the projectile, for instance in the form of a bursting charge.

The present invention provides a well functioning device for emitting radiation which device has prominent technical and economic advantages. The feature that can mainly be considered to be characteristic of a device according to the invention is that it comprises a pyrotechnical charge arranged inside the projectile body, with the space allotted to said charge inside the body being connected via a channel or passage with an opening in the side of the projectile body to emit radiation, produced by activation of said charge, via said opening.

An embodiment proposed at present of a device that has the characteristics significant for the invention will be described in the following, with reference to the attached drawing, in which FIG. 1 in cross-section shows an anti-aircraft projectile utilizing the invention, and FIG. 2 in cross-section and an enlargment shows a part comprised in FIG. 1.

Figure 1:
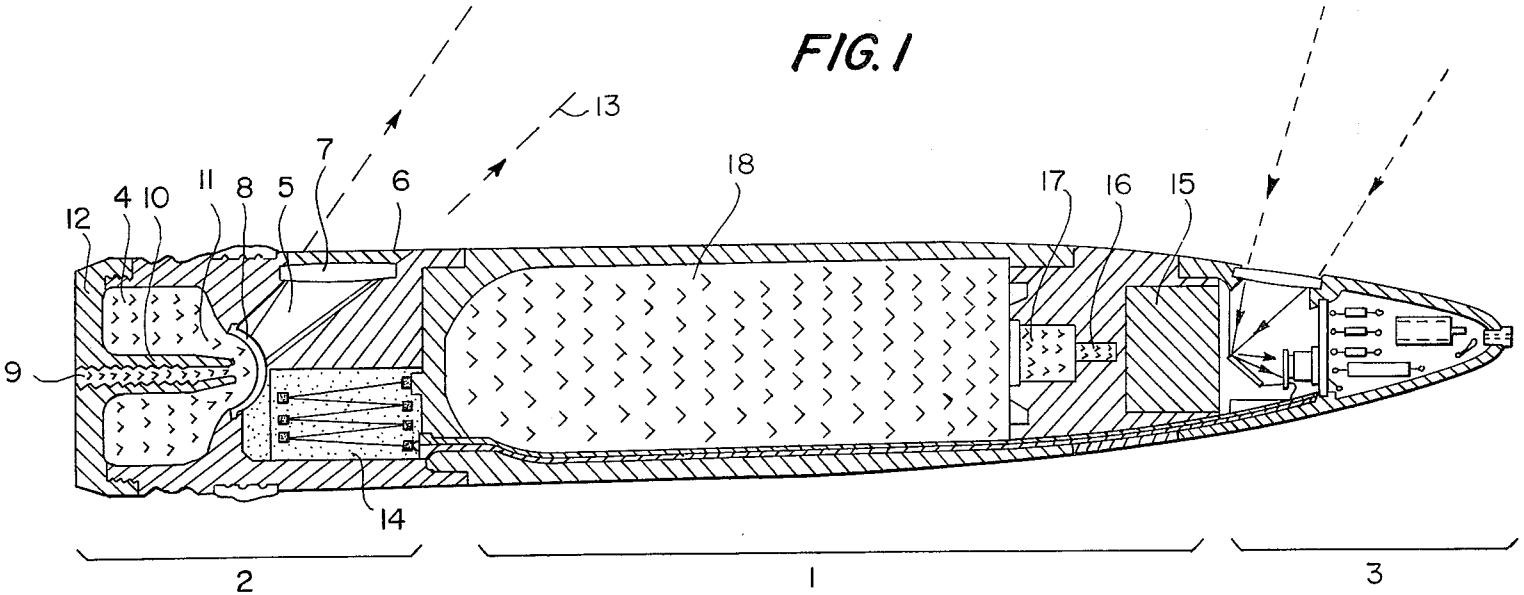

The anti-aircraft projectile according to FIG. 1 comprises, in principle, three parts, viz. an effect part 1, and two units 2 and 3 forming a proximity fuze, of which the unit 2 is a transmitter unit and 3 is a receiver unit. Of said parts, the present invention relates only to the transmitter unit 2, while the other two units have been included only to show the invention in an application where the design has been realized. The effect part 1 and the receiver unit 3 will only be dealt with briefly in the following.

The transmitter unit 2 which in the example of the embodiment shown is located in the rear section of the projectile body includes a pyrotechnical charge 4 located within a space in the body which is rotation-symmetrical. Said space is connected via a channel 5 in the projectile body with an opening in the envelope surface of the body which is covered with a protective cover 6 for a lens 7 fitted at the opening.

The space for the pyrotechnical charge 4 is connected with the channel 5 via a membrane 8 which can be heated by the pyrotechnical charge. The membrane 8, which is heated to a temperature of 2800°C, will in this way serve as a source of radiation, and is therefore made of a heat-resisting material, e.g. tungsten carbide or a corresponding material. The membrane is shaped in the form of a hemisphere and is positioned with the convex surface directed towards the front of the projectile, whereby the mechanical strength will be comparatively great against the acceleration stresses of 40 000 – 50 000 g which occur in the projectile. In certain cases, in order to prevent altogether too rapid oxidation in connection with the heating, the membrane 8 may be hermetically sealed. The alternative to having the membrane is to provide an open hole, the pressure conditions in the space for charge 4 and the channel 5 then having to be arranged so that the hot gases from the pyrotechnical charge 4 are prevented from reaching the lens 7.

The pyrotechnical charge can be initiated via a delay charge 9 which is ignited by the temperature in a gun barrel used to fire the projectile. Delay charge 9 is located in a tubular and rotation-symmetrical part 10 arranged centrally in the space for the pyrotechnical charge 4 and extending through the major portion of that space to the concave surface of the membrane 8, and the through hole of which supports the delay charge. Said delay charge 9 will initiate the pyrotechnical charge 4 at its front end. After the initiation, the through hole in part 10 will serve as an exhaust channel for the exhaust gases from the pyrotechnical charge 4. Due to the fact that the part 10 extends all the way to the membrane 8, a constriction forming a passage for the exhaust gases at the membrane will be obtained, which means that the membrane will have maximum exposure to the hot gases. Through the rotation in the projectile, residue and solid particles formed during the combustion of the charge 4 will be thrown out by the centrifugal force towards the inner wall of the space for the charge 4, as the charge burns axially, whereby as smooth combustion as possible will be obtained.

The through hole in the part 10 emerges centrally in the bottom plate 12 of the projectile, counteracting formation of turbulence behind the projectile. Through the position shown, the delay charge 9 performs an added function when it is utilized since it acts as an obturation plug when the projectile is fired and thereby prevents the propellant gases for the projectile in the gun barrel from penetrating and destroying the transmitter unit.

In the design shown employing a spherical membrane 8 and the inserted tubular part in the space for the pyrotechnical charge, it is appropriate to give the charge 4 a form tapering forwards.

In accordance with the above, the transmitter unit 2 in the proximity fuze, which is intended to work particularly within the infra-red range, transmits a beam, the form of which is determined by the lens 7, which is placed adjacent and connected to the envelope surface of the projectile. The lens 7 is ellipsoidal, so that in the position shown in the projectile body it will be able to emit a symmetrical beam 13. The lens 7 is made of silicon, quartz or the like, in order to be resistant to the adverse environment. An aperture of approx. 2 $cm^2$ has been chosen.

Figure 2:
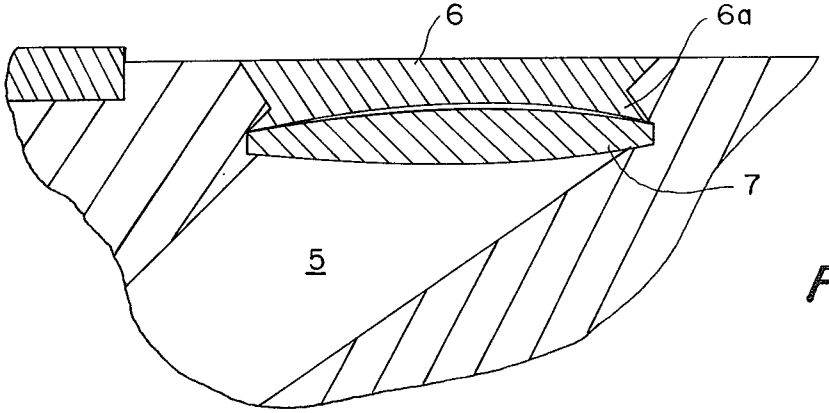

FIG. 2 is intended to show in more detail how the protective cover 6 is fastened in the projectile body. The outer form of the cover coincides with the envelope surface of the projectile, and the cover is moreover made of plastic or corresponding material. The cover 6 is provided with a snap edge 6a which coacts with an obliquely set surface in the body, which snap edge is arranged to give way in response to the centrifugal forces that arise when the projectile is fired from the gun barrel. The cover 6 is thrown to the side and broken up when the projectile leaves the muzzle; it should be mentioned that the projectile is, of course, aerodynamically stable when the cover has been removed from the projectile. Another variant is to make the cover so that it will be removed by the force of the air current that arises at the gun muzzle.

The function of the projectile according to FIG. 1 is, substantially, as follows. When the pyrotechnical charge 4 is ignited, after the delay charge 9 has burned through, after a time that can be chosen at e.g. 0.5 s (arming distance of 500 m), an electric generator 14 responsive to the heat developed by the burning pyrotechnical charge 4 will be activated, and electronic equipment not shown in detail in the receiver unit 3 will then be energized. When the transmitter beam 13 caused by the pyrotechnical charge 4 is reflected by an object to the receiver 3 (within the receiving beam of this) the electronic equipment will be activated to actuate a gap igniter which is known in itself in the delayed arming device 15, which via a priming charge 16 and a bottom charge 17 will ignite a payload in the projectile in the form of a bursting charge 18. The invention is not limited to the embodiment shown above as an example, but can be subject to modifications within the scope of the following claims.

We claim:

1. A device for emitting radiation from a projectile comprising a pyrotechnical charge located within the body of said projectile, an opening in the body of said projectile, means defining a channel extending between said opening and the space within said body containing said pyrotechnical charge for emitting radiation via said channel and opening when said charge has been ignited, and a membrane located between said pyrotechnical charge and said channel, said membrane comprising a source of radiant energy when heated by said pyrotechnicaL charge.

2. The device of claim 1 wherein said membrane is of hemispherical configuration, said membrane being located adjacent said charge with the convex surface of said membrane being directed toward the front end of said projectile.

3. The device of claim 2 wherein said membrane is fabricated of tungsten carbide.

4. The device of claim 3 wherein said pyrotechnical charge is located within a space which is symmetrically disposed about the longitudinal axis of said projectile, the forward end of said space being tapered adjacent said channel.

5. The device of claim 4 wherein said projectile includes a tubular element extending along the longitudinal axis of said projectile into the space for said pyrotechnical charge, said tubular element including an axial hole extending therethrough to provide an exhaust passageway for exhaust gases from said pyrotechnical charge.

6. The device of claim 5 wherein said tubular element extends through the space for said pyrotechnical charge to a position adjacent the concave surface of said membrane thereby to form a constricted passage for gases generated by said pyrotechnical charge adjacent said membrane.

7. The device of claim 5 wherein a delay charge, for the ignition of said pyrotechnical charge, is located within the axial hole extending through said tubular element.

8. The device of claim 5 wherein the rear end of said projectile is defined by a bottom plate, said exhaust channel emerging at the rear end of said projectile at a central location in said bottom plate.

9. The device of claim 1 including a lens located adjacent said opening for controlling the shape of a beam of radiation emitted via said opening, a protective cover located adjacent said lens at the exterior of said projectile, and means for mounting said cover in separable engagement with the body of said projectile to cause said cover to be separated from the projectile when said projectile has been fired thereby to expose said lens.

* * * * *